US006401709B1

(12) United States Patent
Okamoto et al.

(10) Patent No.: US 6,401,709 B1
(45) Date of Patent: Jun. 11, 2002

(54) RANGE HOOD

(75) Inventors: Toshinobu Okamoto; Nobuyuki Morimoto, both of Aichi (JP)

(73) Assignee: Matsushita Seiko Co., Ltd., Osaka (JP)

( * ) Notice: Subject to any disclaimer, the term of this patent is extended or adjusted under 35 U.S.C. 154(b) by 0 days.

(21) Appl. No.: 09/812,888

(22) Filed: Mar. 21, 2001

(30) Foreign Application Priority Data

Apr. 14, 2000 (JP) ..... 2000-113979

(51) Int. Cl.[7] ..... F24C 15/20
(52) U.S. Cl. ..... 126/299 D; 126/299 R
(58) Field of Search ..... 126/299 R, 299 D, 126/300, 21 R; 55/DIG. 36; 454/46, 66, 237, 252

(56) References Cited

U.S. PATENT DOCUMENTS 3,295,433 A * 1/1967 Fox et al. ..... 126/299 D
4,738,244 A * 4/1988 Welsh ..... 126/299 D
5,320,088 A * 6/1994 Nester ..... 126/299 D
5,448,987 A * 9/1995 Jang ..... 126/299 D

FOREIGN PATENT DOCUMENTS

JP 3-42944 4/1991

* cited by examiner

*Primary Examiner*—James C. Yeung
(74) *Attorney, Agent, or Firm*—McDermott, Will & Emery

(57) ABSTRACT

A range hood having an excellent collecting efficiency of greasy smoke generated from a cooking range is provided. The range hood comprises side plates disposed below the body, each of which has an inclined surface formed thereon, and a deflecting plate having a horizontal portion shaped in parallel with the bottom face of the body and an inclined portion shaped in parallel with the inclined surface of the body. The deflecting plate is narrower than the body and arranged so as to form an inlet port at the front and both sides thereof and to form a suction passage between the top face thereof and the body. The inclined portion of the deflecting plate is disposed between the body and the inclined surface of the side plate. Since the inlet speed of greasy smoke at the inlet port on the front side is larger than that on the rear side, greasy smoke ascending along the deflecting plate is effectively collected.

24 Claims, 11 Drawing Sheets

RANGE HOOD

FIELD OF THE INVENTION

The present invention relates to a range hood for exhausting rising greasy smoke generated from a cooking range into the open air.

BACKGROUND OF THE INVENTION

Recently, range hoods exhibiting high collecting efficiency in exhausting greasy smoke produced from cooking into the outdoors has been demanded increasingly.

An example of conventional range hoods such as shown in FIG. 12 and FIG. 13 is known. As illustrated, a conventional household range hood comprises fan 101 installed within hood body 103, passage forming member 102 having downwardly-widening side faces and arranged under fan 101, and suction passage 104 formed around passage forming member 102. Passage forming member 102 is formed in a hollow-body shape having downwardly-widening side faces, provided with an upwardly-protruding upper wall and a horizontal or downwardly-projecting bottom wall. The bottom end of passage forming member 102 is disposed above the bottom end of hood body 103.

Since, in such a conventional range hood, the bottom end of passage forming member 102 is located above the bottom end of the hood body 103 and set back from the front, the suction speed around the periphery of hood body 103 from outside to inside is small. Accordingly, greasy smoke generated from a cooking range, which is not shown, spreads out according as rising up. And thus, it is not sucked into hood body 103 but is released indoors. That is, the conventional range hood has a poor collecting efficiency.

SUMMARY OF THE INVENTION

A range hood capable of effectively collecting greasy smoke generated from a cooking range is provided.

The range hood comprises:

(a) a box-shaped body having a suction opening in its bottom face and a exhaust opening in its top face;

(b) a fan motor disposed within the body for suck the greasy smoke through the suction opening and for exhausting the smoke through the exhaust opening;

(c) side plates provided below the body on both left and right sides each thereof having a rearward-descending inclined surface; and (d) a deflecting plate having a horizontal portion shaped in parallel with the bottom face of the body and an inclined portion shaped in parallel with the inclined surface of the side plate and arranged so as to form an inlet port on the front and both sides thereof and a suction passage between the top face thereof and the body. The inclined portion of the deflecting plate is disposed between the body and the inclined surface of the deflecting plate.

Greasy smoke generated from the range collides with the bottom face of the deflecting plate and is drawn in through the inlet port on both sides. Greasy smoke moving along the deflecting plate is also drawn in through the inlet port at the front where the inlet speed is higher. Greasy smoke is then passed through the suction passage and sucked in at the suction opening to be exhausted. That is, the range hood has a high efficiency in collecting greasy smoke.

DESCRIPTION OF THE PREFERRED EMBODIMENTS

Exemplary Embodiment 1

Figure 1:
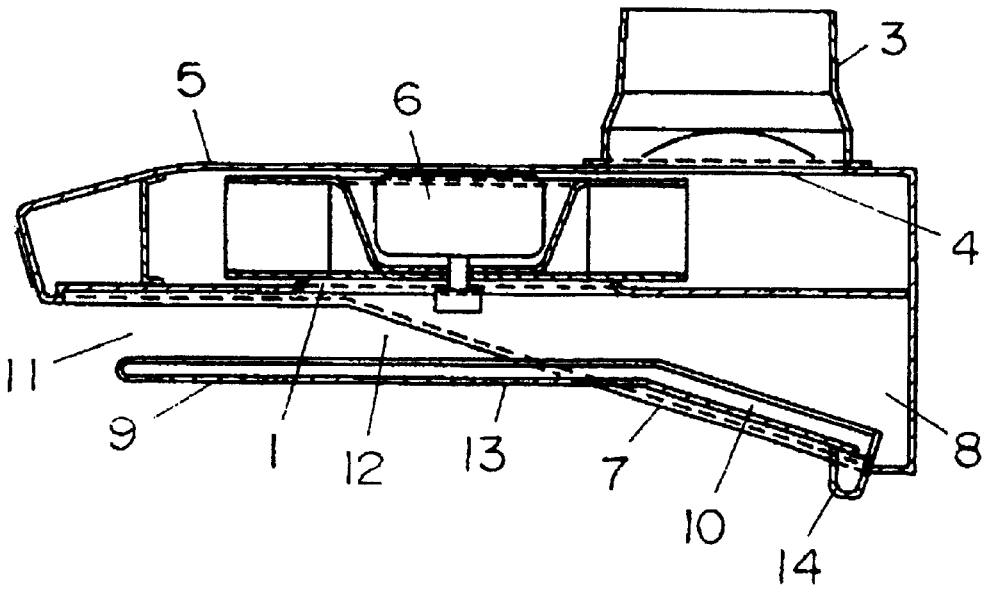
FIG. 1 is a sectional view of a range hood according to exemplary embodiment 1 of the invention.
Figure 2:
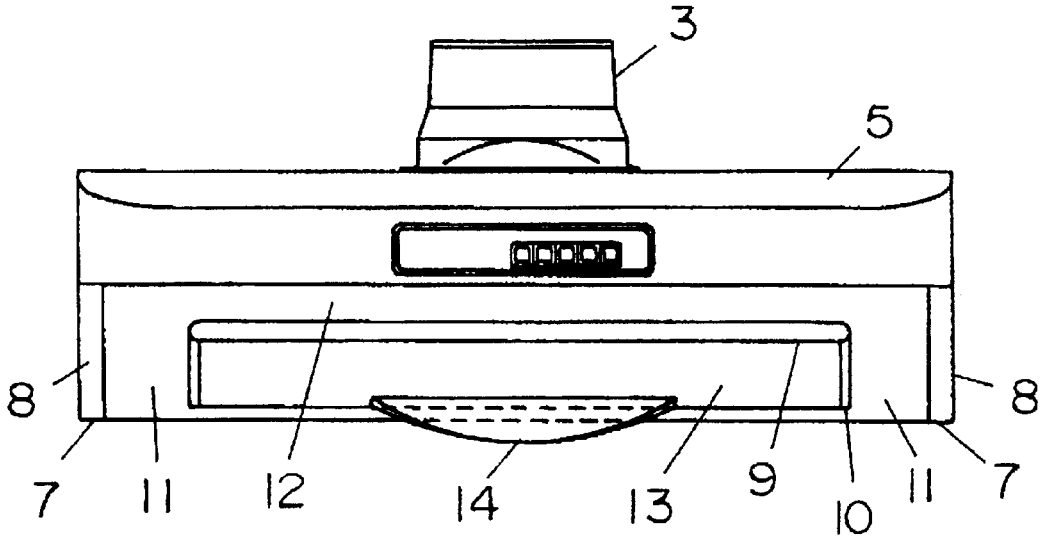
FIG. 2 is a front view of the range hood according to embodiment 1.
Figure 3:
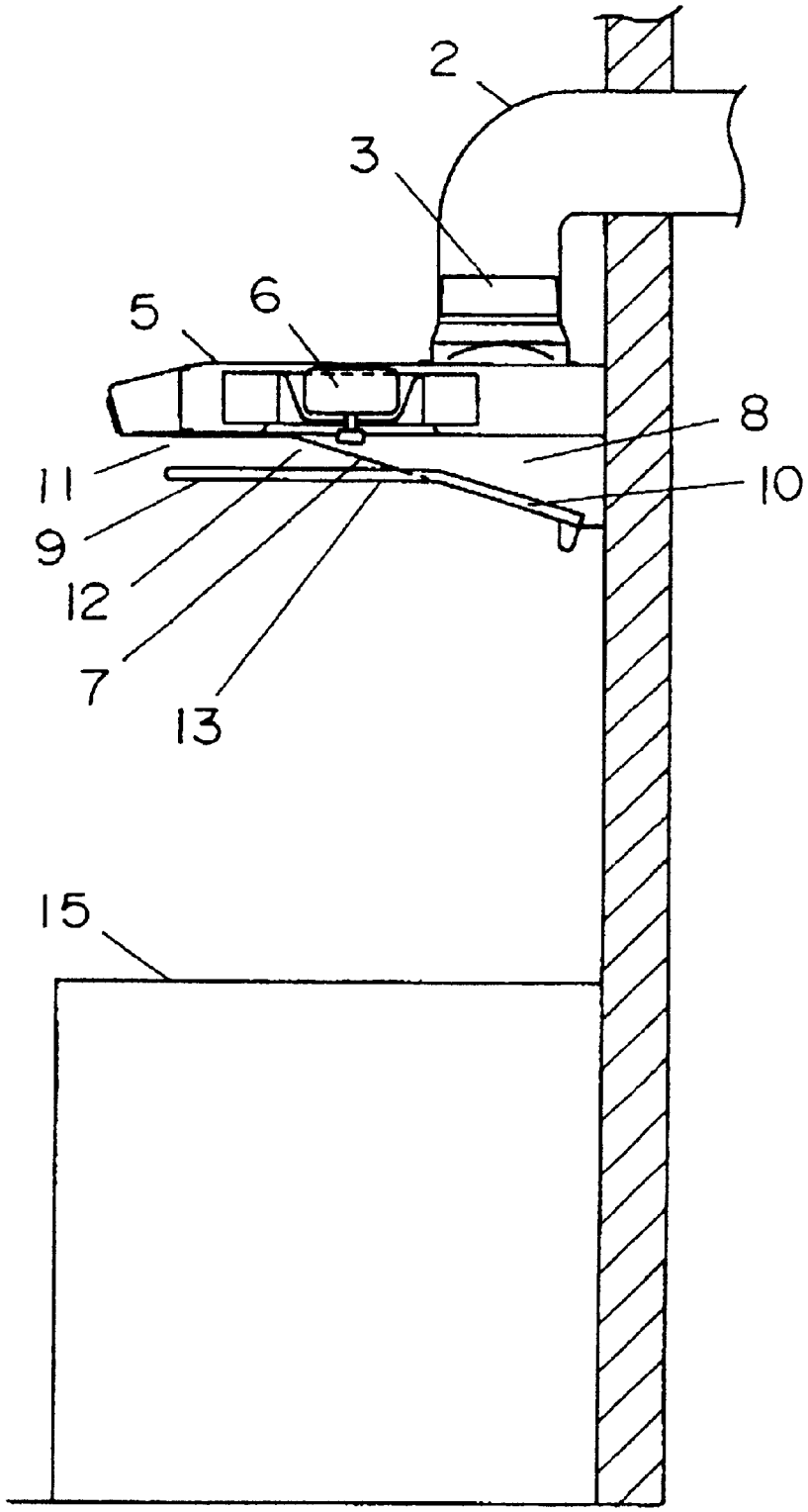
FIG. 3 is a side view showing a state of the range hood set up above a cooking range.

FIG. 1 is a sectional view of a range hood according to exemplary embodiment 1 of the present invention. FIG. 2 is a front view of the range hood. FIG. 3 is a side view showing a state of the range hood installed above a cooking range.

Box-shaped body 5 has suction opening 1 in the bottom face and exhaust opening 4 in the top face provided with exhaust adapter 3 to be connected with duct 2 communicating with the outdoors. Within body 5, fan motor 6 is provided for sucking gas, e.g. greasy smoke, and for exhausting it from exhaust opening 4. On both left and right sides below body 5, side plates 8 are provided. Side plate 8 has inclined surface 7 descending rearward. Deflecting plate 13 has horizontal portion 9 shaped in parallel with the bottom face of body 5 and inclined portion 10 shaped in parallel with inclined surface 7 of side plate 8. Deflecting plate 13 is narrower than body 5. And therefore, plate 13 forms inlet port 11 at its front and both sides and suction passage 12 between its top face and body 5. Further, deflecting plate 13 has oil pan 14 provided at its lower end. Inclined portion 10 of deflecting plate 13 is disposed between body 5 and inclined surface 7 of side plate 8. The range hood is set up above range 15.

When the range hood is operated during the use of range 15, fan motor 6 is driven, so that greasy smoke generated from range 15 ascends. Greasy smoke may collide with deflecting plate 13 or be directly sucked in from inlet port 11 provided at the sides of deflecting plate 13. While ascending along inclined portion 10 of deflecting plate 13, greasy smoke collided with deflecting plate 13 moves toward the side of horizontal portion 9. The distance between deflecting plate 13 and body 5 on the front side is narrower than that on the rear side. Therefore, the inlet speed of greasy smoke on the front side of deflecting plate 13 is larger than that on the rear side. Accordingly, greasy smoke collided with deflecting plate 13 is sucked in through inlet port 11 on the front side of deflecting plate 13. Greasy smoke passed through suction passage 12 is sucked into body 5 through suction opening 1 made in the body and then exhausted into the outdoors from exhaust opening 4 through duct 2. A portion of greasy smoke collected by the range hood attaches onto the bottom face of body 5 or the top face of deflecting plate 13 and moves along inclined portion 10 of deflecting plate 13 to be recovered in oil pan 14.

The range hood according to exemplary embodiment 1, as described above, allows greasy smoke ascending to the front of deflecting plate 13 to be drawn therein, while allowing greasy smoke ascending to the rear of the deflecting plate 13 to be guided toward the front side by means of inclined portion 10 and effectively drawn in there, and allows them to be exhausted.

Further, in the range hood, greasy smoke attached to deflecting plate 13 can be recovered smoothly and cleaned up easily.

Exemplary Embodiment 2

Figure 4:
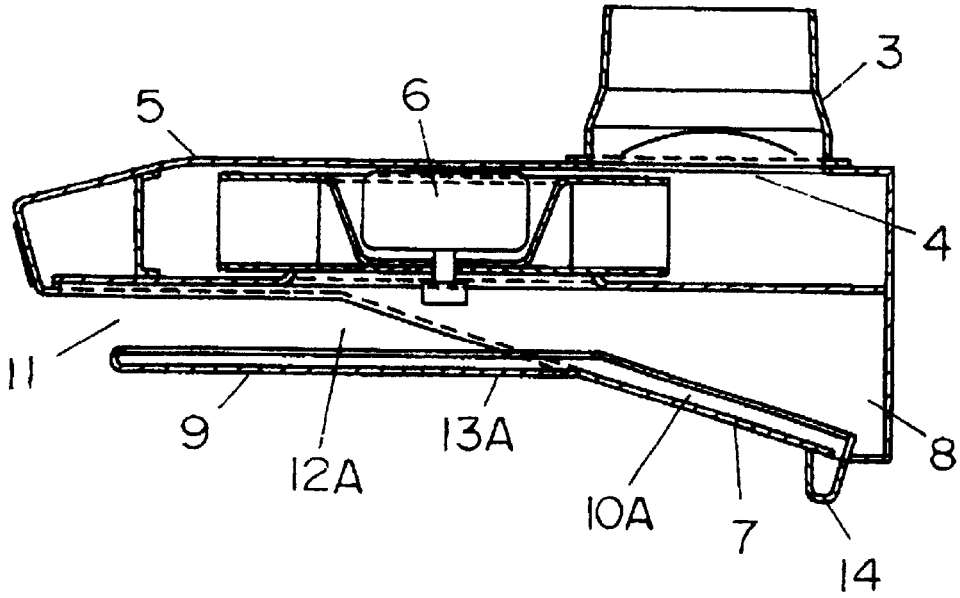
FIG. 4 is a sectional view of a range hood according to exemplary embodiment 2 of the invention.
Figure 5:
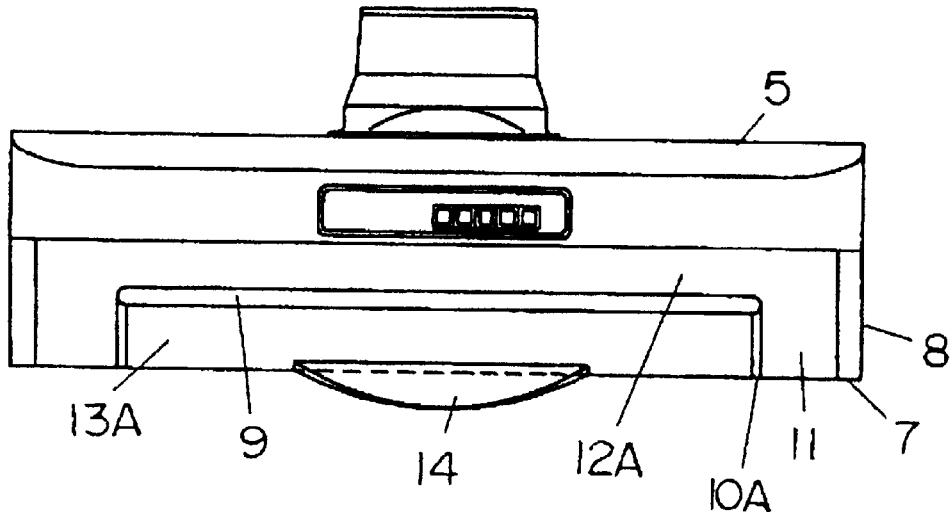
FIG. 5 is a front view of the range hood according to embodiment 2.

FIG. 4 is a sectional view of a range hood according to exemplary embodiment 2 of the invention. FIG. 5 is a front view of the range hood according to embodiment 2. Inclined portion 10A of deflecting plate 13A is placed virtually in agreement with the position of inclined surface 7 of side plate 8 on body 5. Its other configuration is the same as exemplary embodiment 1, and explanation thereof will be hence omitted.

Suction passage 12A on the side of inclined portion 10A is made narrower because inclined portion 10A of deflecting plate 13A is placed closer to the bottom face side of body 5 than that in embodiment 1. Accordingly, when fan motor 6 is driven, inlet port 11 sucks greasy smoke at greater speed than that in embodiment 1. However, suction flow of greasy smoke on the rear side is also large. Thus, this range hood draws and exhausts the greasy smoke smoothly through the overall inlet port 11 formed at sides and in front of deflecting plate 13A.

Exemplary Embodiment 3

Figure 6:
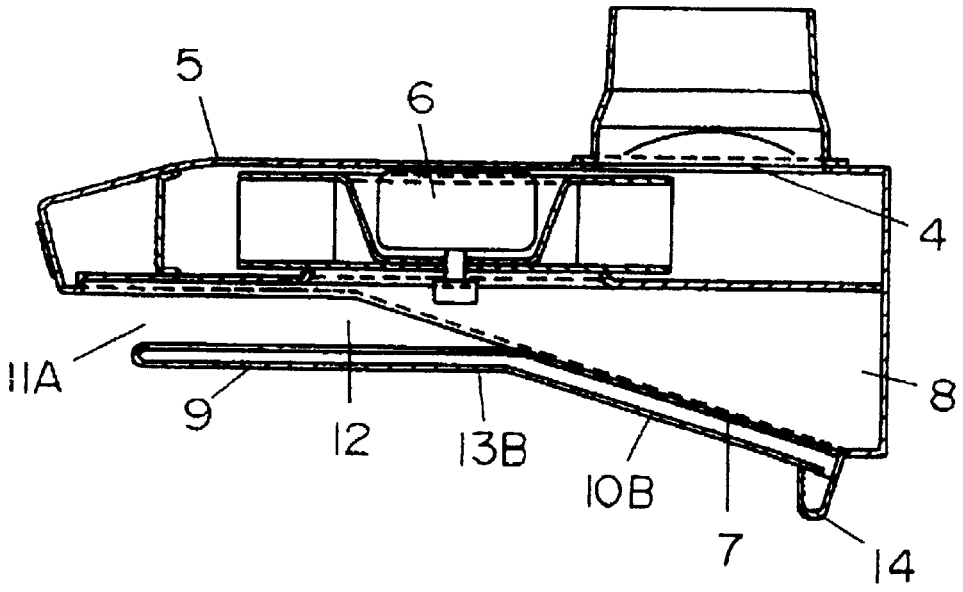
FIG. 6 is a sectional view of a range hood according to exemplary embodiment 3 of the invention.
Figure 7:
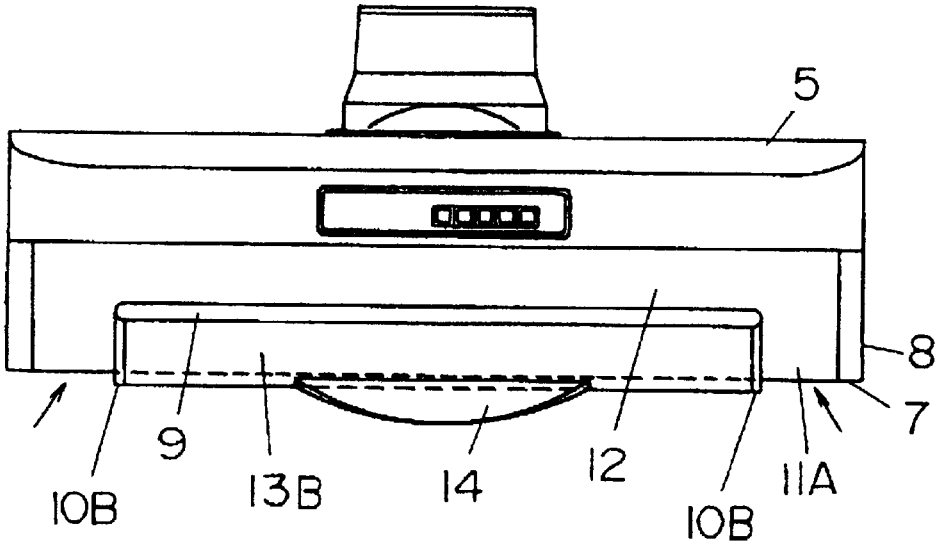
FIG. 7 is a front view of the range hood according to embodiment 3.

FIG. 6 is a sectional view of a range hood according to exemplary embodiment 3 of the invention. FIG. 7 is a front view of the range hood according to embodiment 3. Inclined portion 10B of deflecting plate 13B is positioned farther away from body 5 than inclined surface 7 of side plate 8 on body 5. Its other configuration is the same as that in embodiment 1, and explanation thereof will be hence omitted.

Inclined portion 10B of deflecting plate 13B projects below inclined surface 7 of side plates 8 so that inlet port 11A opens obliquely outward. Therefore, when fan motor 6 is driven, inlet port 11A sucks air in wide area at both sides of inclined portion 10B, and the vector of the inlet flow directs from outside to inside. Greasy smoke flowing toward the outside of body 5 is sucked through inlet port 11A and then exhausted.

Exemplary Embodiment 4

Figure 8:
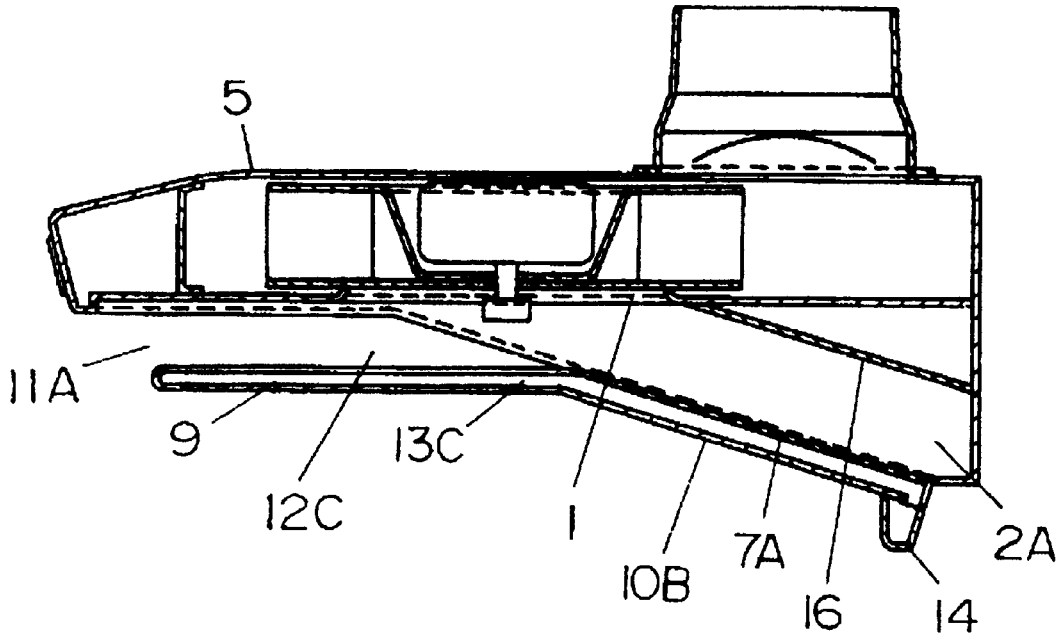
FIG. 8 is a sectional view of a range hood according to exemplary embodiment 4 of the invention.
Figure 9:
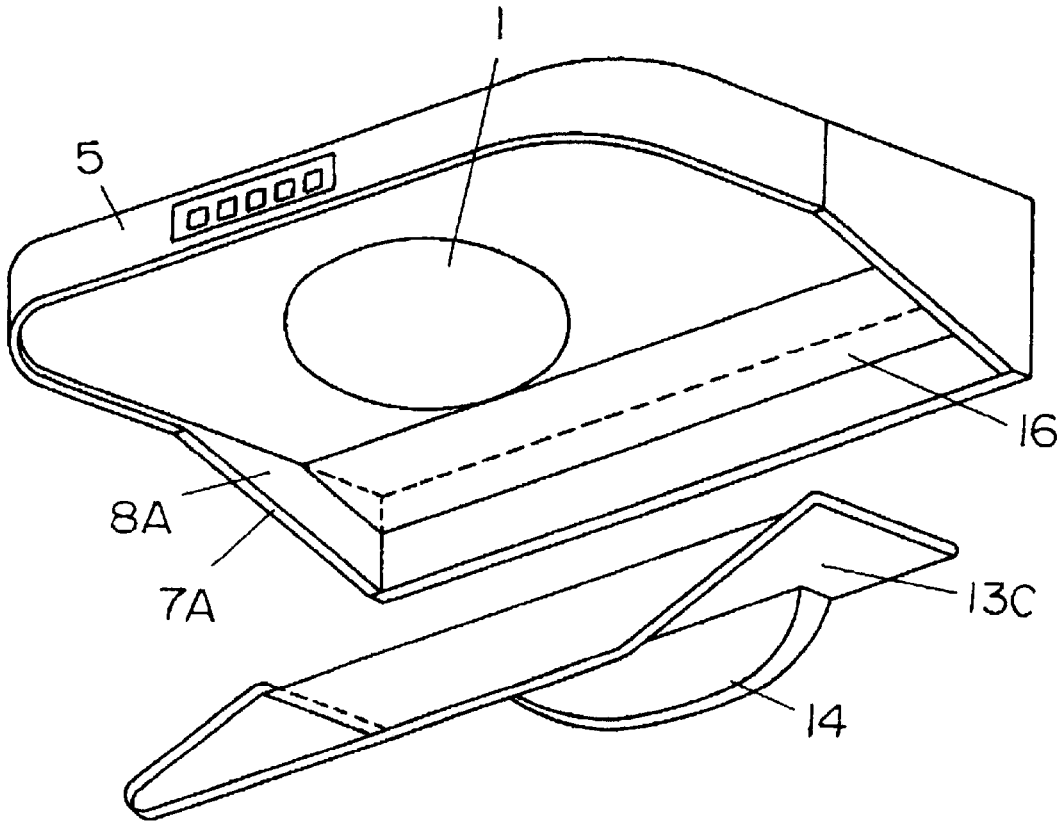
FIG. 9 is a perspective view of the range hood according to embodiment 4 with a deflecting plate removed therefrom.

FIG. 8 is a sectional view of a range hood according to exemplary embodiment 4 of the invention. FIG. 9 is a perspective view of the range hood according to embodiment 4 with the deflecting plate removed therefrom. The range hood has guide plate 16 which is disposed between side plates 8A and have substantially the same inclination as that of inclined surface 7A formed at the bottom of side plates 8A, for guiding greasy smoke to suction opening 1. Its other configuration is the same as exemplary embodiment 1, and explanation thereof will be hence omitted.

Guide plate 16 forms suction passage 12C between body 5 and deflecting plate 13 substantially at a uniform height. When fan motor 6 is driven, greasy smoke is drawn in at substantially equal inlet speeds on the front side and the rear side and thus sucked in a balanced manner to be exhausted.

Exemplary Embodiment 5

Figure 10:
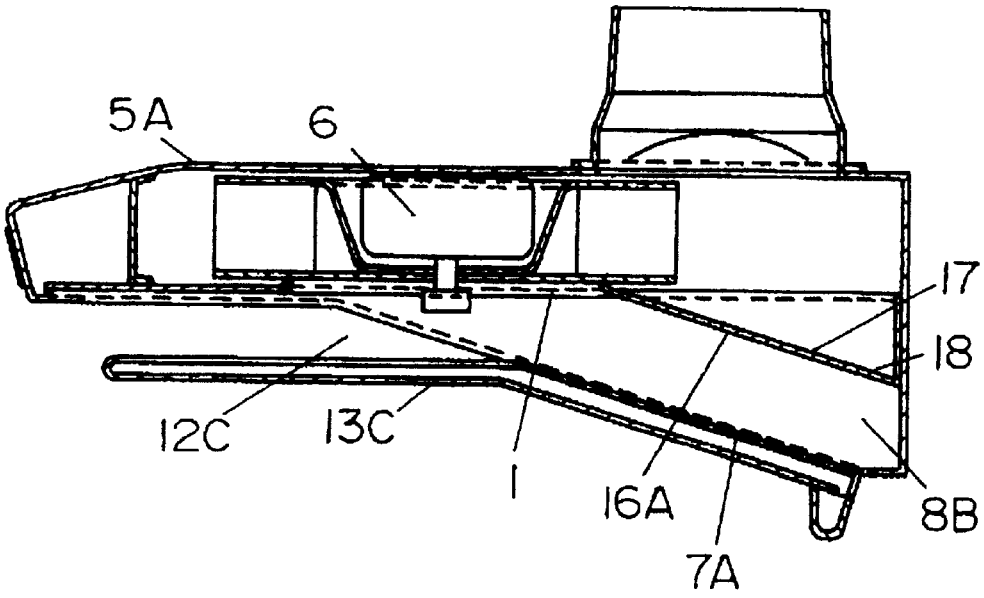
FIG. 10 is a sectional view of a range hood according to exemplary embodiment 5 of the invention.
Figure 11:
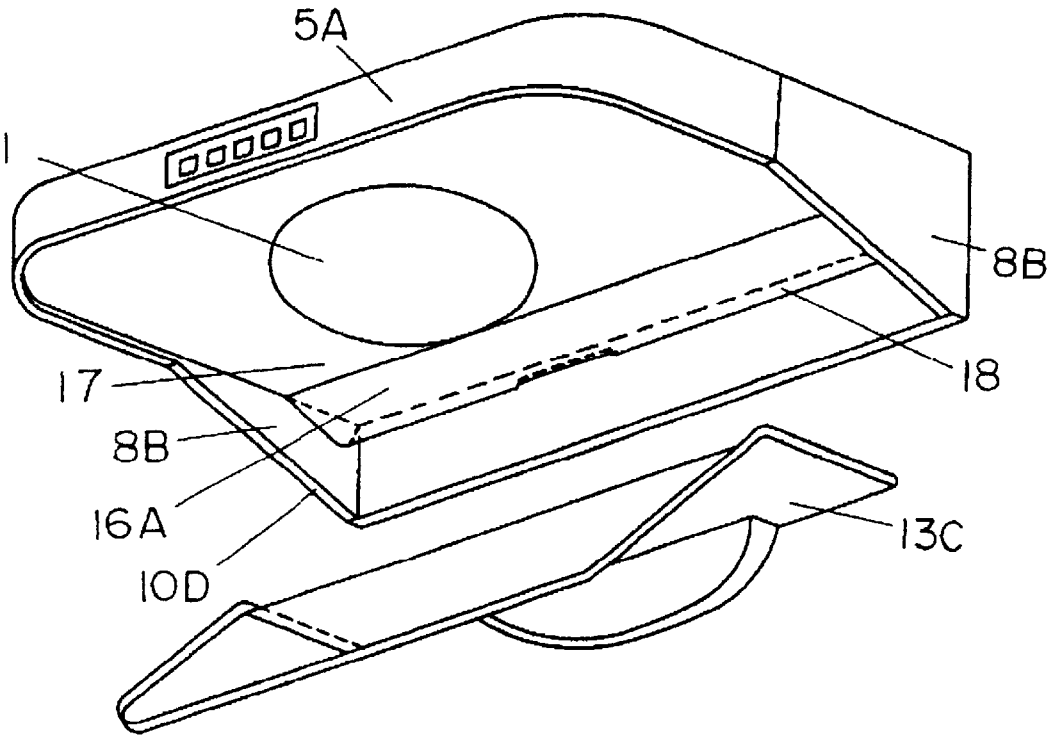
FIG. 11 is a perspective view of the range hood according to embodiment 5 with a deflecting plate removed therefrom.
Figure 12:
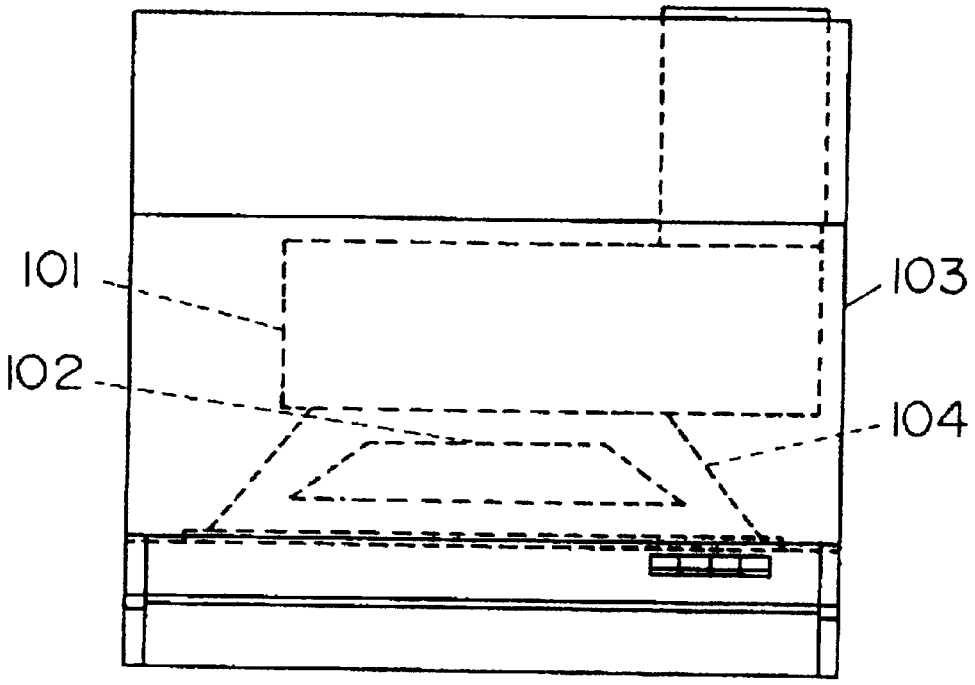
Fig. 12 Prior Art
FIG. 12 is a front view of a conventional range hood.
Figure 13:
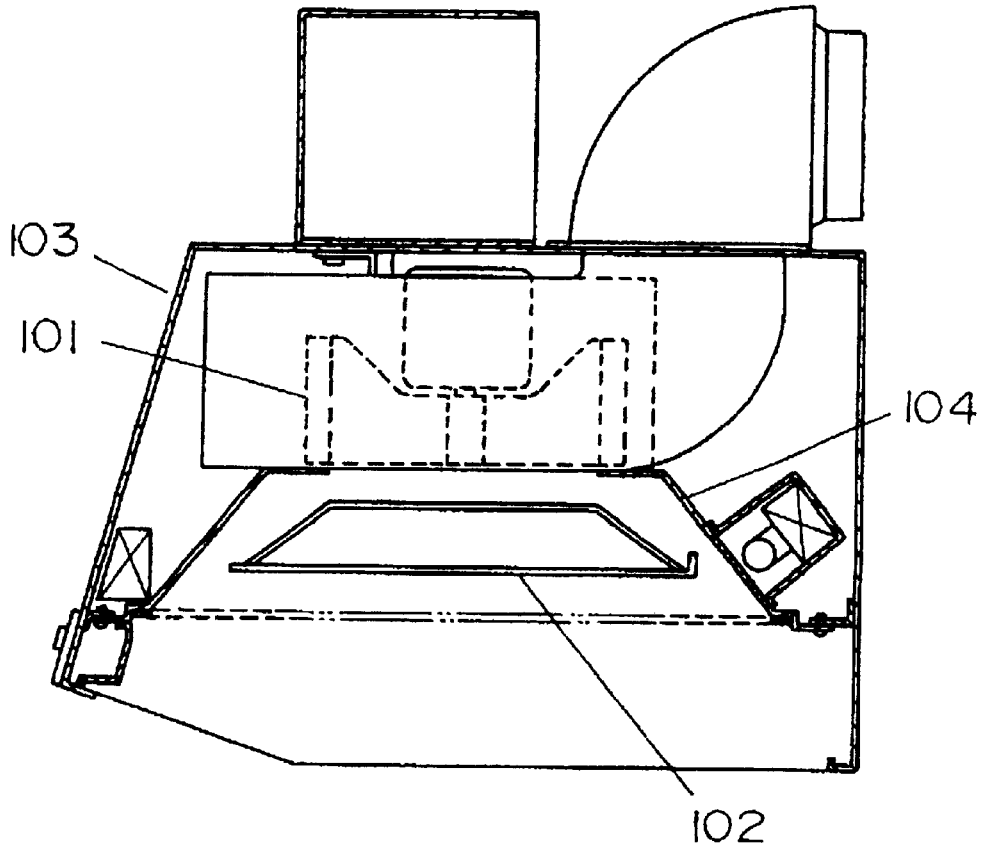
Fig. 13 Prior Art
FIG. 13 is a sectional view of the conventional range hood.

FIG. 10 is a sectional view of a range hood according to exemplary embodiment 5 of the invention. FIG. 11 is a perspective view of the range hood according to embodiment 5 with the deflecting plate removed therefrom.

A portion of bottom panel 17 on its rear side of body 5A is bent to form guide 16A and oil pan 18 therein. Guide 16A is formed to have substantially the same inclination as that of inclined surface 7A of side plates 8B for guiding greasy smoke to suction opening 1. Its other configuration is the same as embodiment 3, and description will be hence omitted.

Guide plate 16A forms suction passage 12C between body 5A and deflecting plate 13C substantially at a uniform height. When fan motor 6 is driven, greasy smoke is drawn in at substantially equal inlet speeds on the front side and the rear side and thus sucked in a balanced manner to be exhausted.

Since guide plate 16A is formed with utilizing bottom panel 17 of body 5A, another guide plate is not required. Further, guide plate 16A guides greasy smoke attaching to the bottom face of body 5A toward a preset position smoothly so as to recover the guided smoke.

What is claimed is:

1. A range hood comprising:

a body having a substantially box shape; a suction opening on a bottom face thereof and an exhaust opening on a top face thereof;

a fan motor for drawing gas into said body through the suction opening and for exhausting the gas through the exhaust opening;

two side plates disposed below said body, one of said side plates positioned on a first side of said body and the other of said side plates positioned on a second side of said body, each of said side plates having a rearward-descending inclined surface; and a deflecting plate having a horizontal portion positioned parallel with the bottom face of said body and an inclined portion positioned parallel with the inclined surface of said two side plates and arranged so as to form an inlet port adjacent a front side thereof and adjacent a first and second side thereof; and a suction passage between a top face thereof and said body, a portion of said horizontal portion of said deflecting plate extending beyond said two side plates.

2. The range hood according to claim 1, wherein said deflecting plate is disposed such that the inclined portion thereof is located between said body and the inclined surface of each of said side plates.

3. The range hood according to claim 2 further comprising an oil pan disposed at a bottom end of the inclined portion of said deflecting plate.

4. The range hood according to claim 1, wherein said deflecting plate is disposed such that the inclined portion of said deflecting plate is substantially aligned with the inclined surface of each of said side plates.

5. The range hood according to claim 4 further comprising an oil pan disposed at a bottom end of the inclined portion of said deflecting plate.

6. The range hood according to claim 1, wherein said deflecting plate is disposed such that the inclined portion of said deflecting plate is located further away from said body than the inclined surface of each of said side plates.

7. The range hood according to claim 6 further comprising an oil pan disposed at a bottom end of the inclined portion of said deflecting plate.

8. The range hood according to claim 1 further comprising a guide plate disposed between said two side plates, said guide plate having substantially the same inclination as that of the inclined surface of each of said side plates.

9. The range hood according to claim 8 further comprising an oil pan disposed at a bottom end of the inclined portion of said deflecting plate.

10. The range hood according to claim 1, wherein a rear portion of a panel of the bottom face of said body is bent in substantially the same inclination as that of the inclined surface of each of said side plates.

11. The range hood according to claim 10 further comprising an oil pan disposed at a bottom end of the inclined portion of said deflecting plate.

12. The range hood according to claim 1 further comprising an oil pan disposed at a bottom end of the inclined portion of said deflecting plate.

13. A range hood according to claim 1, wherein said deflecting plate is narrower than a distance between said side plates and disposed below the bottom face of said body.

14. The range hood according to claim 13, wherein said deflecting plate is disposed such that the inclined portion of said deflecting plate is located between said body and the inclined surface of each of said side plates.

15. The range hood according to claim 14 further comprising an oil pan disposed at a bottom end of the inclined portion of said deflecting plate.

16. The range hood according to claim 13, wherein said deflecting plate is disposed such that the inclined portion of said deflecting plate is substantially aligned with the inclined surface of each of said side plates.

17. The range hood according to claim 16 further comprising an oil pan disposed at a bottom end of the inclined portion of said deflecting plate.

18. The range hood according to claim 13, wherein said deflecting plate is disposed such that the inclined portion of said deflecting plate is located further away from said body than the inclined surface of each of said side plate.

19. The range hood according to claim 18 further comprising an oil pan disposed at a bottom end of the inclined portion of said deflecting plate.

20. The range hood according to claim 13 further comprising a guide plate disposed between said side plates, said guide plate having substantially the same inclination as that of the inclined surface of each of said side plates.

21. The range hood according to claim 20 further comprising an oil pan disposed at a bottom end of the inclined portion of said deflecting plate.

22. The range hood according to claim 13, wherein a rear portion of a panel of the bottom face of said body is bent in substantially the same inclination as that of the inclined surface of each of said side plates.

23. The range hood according to claim 22 further comprising an oil pan disposed at a bottom end of the inclined portion of said deflecting plate.

24. The range hood according to claim 13 further comprising an oil pan disposed at a bottom end of the inclined portion of said deflecting plate.

* * * * *